US011002020B2

(12) United States Patent
Hannig

(10) Patent No.: US 11,002,020 B2
(45) Date of Patent: May 11, 2021

(54) FLOOR PANEL MADE OF PLASTIC HAVING MECHANICAL LOCKING EDGES

(71) Applicant: AKZENTA PANEELE + PROFILE GMBH, Kaisersesch (DE)

(72) Inventor: Hans-Jürgen Hannig, Bergisch Gladbach (DE)

(73) Assignee: AKZENTA PANEELE & PROFILE GMBH, Kaisersesch (DE)

( * ) Notice: Subject to any disclaimer, the term of this patent is extended or adjusted under 35 U.S.C. 154(b) by 0 days.

(21) Appl. No.: 15/660,363

(22) Filed: Jul. 26, 2017

(65) Prior Publication Data

US 2017/0335571 A1 Nov. 23, 2017

Related U.S. Application Data

(63) Continuation of application No. 13/027,368, filed on Feb. 15, 2011, now Pat. No. 9,745,756, which is a continuation of application No. PCT/EP2009/059487, filed on Jul. 23, 2009.

(30) Foreign Application Priority Data

Sep. 1, 2008 (DE) ..... 20 2008 011 589.2

(51) Int. Cl.
*E04F 15/02* (2006.01)
*E04F 15/04* (2006.01)

(52) U.S. Cl.
CPC ..... *E04F 15/02* (2013.01); *E04F 15/02033* (2013.01); *E04F 15/04* (2013.01); *E04F 2201/0138* (2013.01); *E04F 2201/0153* (2013.01)

(58) Field of Classification Search
CPC ..... E04F 15/02; E04F 15/02033; E04F 15/02038; E04F 15/04; E04F 2201/0138; E04F 2201/0153
USPC ..... 52/592.1, 592.2, 589.1, 591.1, 591.3, 52/591.4
See application file for complete search history.

(56) References Cited

U.S. PATENT DOCUMENTS 3,382,302 A * 5/1968 Marzocchi ..... B29C 44/12 156/78
4,955,171 A * 9/1990 Kossatz ..... B28B 1/525 156/242
6,006,486 A * 12/1999 Moriau ..... B27F 1/06 52/586.1
6,324,796 B1 * 12/2001 Heath ..... E04B 5/026 52/177
6,345,481 B1 * 2/2002 Nelson ..... E04F 15/02 52/592.2

(Continued)

FOREIGN PATENT DOCUMENTS

DE WO-2006133690 A1 * 12/2006 ..... E04F 15/02038

*Primary Examiner* — Jessie T Fonseca
(74) *Attorney, Agent, or Firm* — Lucas & Mercanti, LLP; Klaus P. Stoffel

(57) ABSTRACT

A floor panel has a carrier layer which is a plastic material that is pliable and elastic at an application temperature of the flooring. A decorative layer is disposed above the carrier layer. Complementary mechanical locking profiles provided on at least two panel edges. The locking profiles cooperating in the locked state of two floor panels and counter-acting a moving apart of the floor panels. At least one panel edge has an edge break-away point at the edge of the decorative layer.

12 Claims, 3 Drawing Sheets

(56) References Cited

U.S. PATENT DOCUMENTS

| | | | | |
|---|---|---|---|---|
| 6,931,811 | B2 * | 8/2005 | Thiers | B44C 1/24 428/195.1 |
| 7,047,697 | B1 * | 5/2006 | Heath | E04F 15/10 52/177 |
| 8,245,478 | B2 * | 8/2012 | Bergelin | E04F 15/02 428/192 |
| 8,341,915 | B2 * | 1/2013 | Pervan | E04F 21/22 52/396.04 |
| 8,495,849 | B2 * | 7/2013 | Pervan | E04F 15/02 52/592.1 |
| 2002/0046528 | A1 * | 4/2002 | Pervan | E04F 15/02 52/588.1 |
| 2003/0024199 | A1 * | 2/2003 | Pervan | E04F 15/04 52/589.1 |
| 2003/0033777 | A1 * | 2/2003 | Thiers | B32B 7/02 52/390 |
| 2004/0219339 | A1 * | 11/2004 | Dempsey | B26F 1/40 428/204 |
| 2005/0050827 | A1 * | 3/2005 | Schitter | B44C 5/043 52/578 |
| 2005/0235593 | A1 * | 10/2005 | Hecht | B44C 5/043 52/592.1 |
| 2006/0032175 | A1 * | 2/2006 | Chen | B32B 3/04 52/578 |
| 2006/0179773 | A1 * | 8/2006 | Pervan | B27N 7/00 52/592.1 |
| 2007/0130872 | A1 * | 6/2007 | Goodwin | E04F 15/02 52/592.1 |
| 2008/0010938 | A1 * | 1/2008 | Hannig | E04F 15/02 52/591.4 |
| 2008/0209838 | A1 * | 9/2008 | Pervan | B44C 3/12 52/588.1 |

* cited by examiner

FLOOR PANEL MADE OF PLASTIC HAVING MECHANICAL LOCKING EDGES

CROSS-REFERENCE TO RELATED APPLICATIONS

The present application is a Continuation application of U.S. patent application Ser. No. 13/027,368, filed Feb. 15, 2011, which is a Continuation of PCT/EP2009/059487 filed Jul. 23, 2009 which in turn claimed the priority of German Patent Application No. 20 2008 011 589.2 filed Sep. 1, 2008, the priority of these applications is hereby claimed and these applications are incorporated herein by reference.

BACKGROUND OF THE INVENTION

The invention relates to a floor panel comprising a carrier layer comprising a plastic material that is pliable and elastic at an application temperature of the flooring, a decorative layer being disposed above the carrier layer, complementary mechanical locking means being provided on at least two panel edges, said locking means cooperating in the locked state of the two floor panels and counteracting a moving-apart of the floor panels.

A floor panel of this kind is known from DE 199 44 399 A1. It comprises a carrier layer of a plastic material that is pliable and yet largely resistant to dents. Hitherto, hard, rigid wood or wood-like materials have been used for the carrier layer, but in the known floor panel this material is replaced by a plastic material.

In floor panels which are made of compacted fiberboard and which include mechanical locking means, the quality and strength of the mechanical locking decrease with a decreasing thickness of the backing. Compared thereto, a carrier layer made of a plastic material exhibits a higher strength. It is thus possible to fabricate floor panels that have a lower overall thickness than floor panels that comprise a carrier layer made of a wood fiber material.

A floor covering made up of floor panels of the described kind and essentially consisting of a plastic material is suitable for floating installation, i.e. the floor panels are supported loosely on the ground; an adhesive connection is omitted. Temperature fluctuations make the individual floor panels expand or shrink. The occurring forces burden the mechanical locking and can accordingly cause the floor panels to move apart thus forming a gap between the adjacent panel edges. Such gaps are considered to be unaesthetic in a floor covering. Moreover, the robustness of the surface of the floor suffers if such gaps are formed.

SUMMARY OF THE INVENTION

The invention is based on the object of providing a floor panel that allows the fabrication of aesthetically more appealing and also more durable floor coverings.

According to the invention, this object is achieved by at least one panel edge having an edge break-away point at the edge of the decorative layer. Preferably, all of the panel edges are provided with an edge break-away point according to the invention at the edge of the decorative layer. In the installed floor covering, the edge break-away point optically emphasizes the joint and thus serves as an aesthetic design medium. Moreover, the edge break-away point provides protection of the panel edges. This largely avoids material breaking away from the panel edge.

For instance, the edge break-away point can be configured as a chamfer, radius or mortise. Preferably, the mortises are each formed as a stepped recess. Two assembled floor panels with the chamfer at the panel edges form a V-joint. Two assembled panel edges with the mortise at the panel edges form a so-called shadow gap.

Preferably, a transparent wear protection layer is provided above the decorative layer. Within the wear protection layer abrasion-preventing particles can be provided, e.g. corundum. Below the carrier layer a counteracting layer can be provided. The same is particularly useful if other layers that introduce stress loads into the panel and thus cause distortion are provided above the carrier layer. In such a case, the counteracting layer provides for a balance so that the floor panel keeps or is given a flat shape.

Additionally, for improving dimensional stability, a reinforcement layer can be provided which includes for instance fiber-reinforced material such as fiber glass etc. The reinforcement layer can be provided as at least one intermediate layer in a split carrier layer.

As a plastics material of the carrier layer, a material from the group of thermoplastic elastomers can be provided. These are among others plastic materials based on polyolefin, polypropylene, polyurethane or polyamide.

On the other hand, as a plastic material of the carrier layer, a material from the group of amorphous elastomers can be provided. But considering that the same exhibit a natural hardness and brittleness, amorphous elastomers of the type containing a plasticizer are provided, for instance the so-called soft polyvinylchloride (PVC).

The thickness of the floor panel preferably amounts to 1.5 mm to 6 mm.

The floor panel simply has four panel edges.

An expedient embodiment provides that at least one of two mutually opposite panel edges has a groove and the opposite panel edge has a tongue that is configured complementary to the groove.

An advantageous further development of the groove-and-tongue floor panel provides that the tongue and the groove each have an undercut, that the undercut of the tongue and the undercut of the groove are designed in such a way that in a locked state they counteract a moving-apart of the floor panels in their plane and vertically to the locked panel edge.

An additional advantageous further development provides that at least two mutually opposite panel edges are provided with complementary hook elements that can be locked with each other in a direction vertical to the plane of the floor panels.

Of course, it is also possible for a floor panel to be provided with a groove and a tongue on a first pair of mutually opposite panel edges and to include complementary hook elements on a second pair of mutually opposite panel edges.

The quality of the mechanical locking by the hook elements can be improved if each of the hook elements has an undercut which is designed in such a manner that in the locked state a hook connection is produced that counteracts movement apart of the floor panels vertically to the plane of the floor panels.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
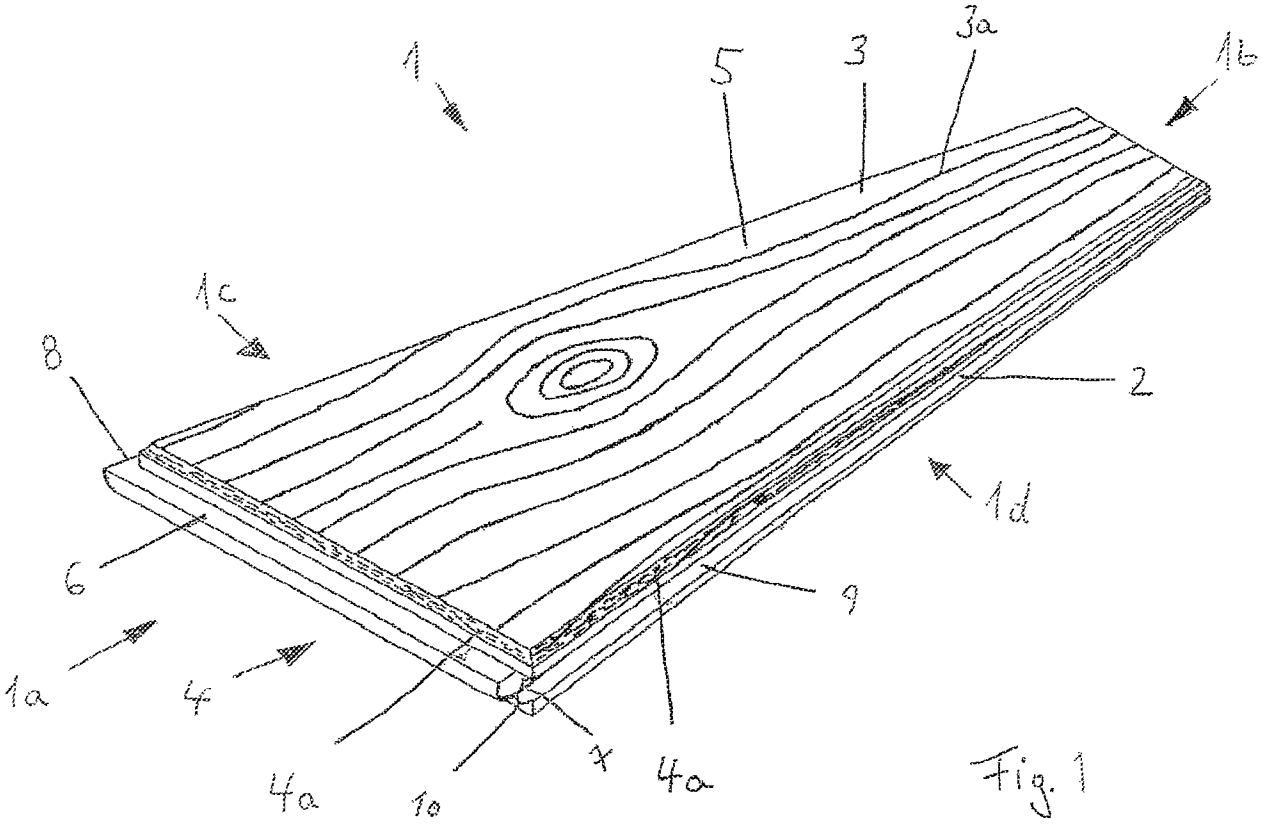
FIG. 1 a perspective view of a floor panel including form-fit mechanical locking means on the panel edges and an edge break-away point in the form of a chamfer.

Illustrated in FIG. 1 is a floor panel 1 according to the invention. It comprises a carrier layer 2 made of a pliable and elastic plastic material. Above the carrier layer 2 a decorative layer 3 is disposed. The decorative layer 3 exhibits a reproduction of a wood grain 3*a*. At the rim of the decorative layer 3 the panel edges 1*a*, 1*b* and 1*c*, 1*d* are provided with an edge break-away point 4 in the form of a chamfer 4*a*. On the decorative layer 3 a transparent wear protection layer 5 is provided. Below the carrier layer is a counteracting layer G, see FIG. 4*b*. Mechanical locking means are provided, namely a first pair of panel edges 1*a* and 1*b*, the panel edge 1*a* thereof includes a tongue 6 having an undercut 7. The opposite panel edge 1*b* is provided with a groove formed complementary to the tongue 6. A second pair of mutually opposite panel edges is also provided with a panel edge 1*c* that includes a tongue 8 having un undercut while the opposite panel edge 1*d* includes a groove 9 with an undercut 10 formed complementary to the tongue 8.

Besides these mechanical locking means also other kinds of mechanical locking means can be provided on one or both pairs of mutually opposite panel edges.

Figures 2A, 2B, 3A, 3B, 3C, 4A, 4B:
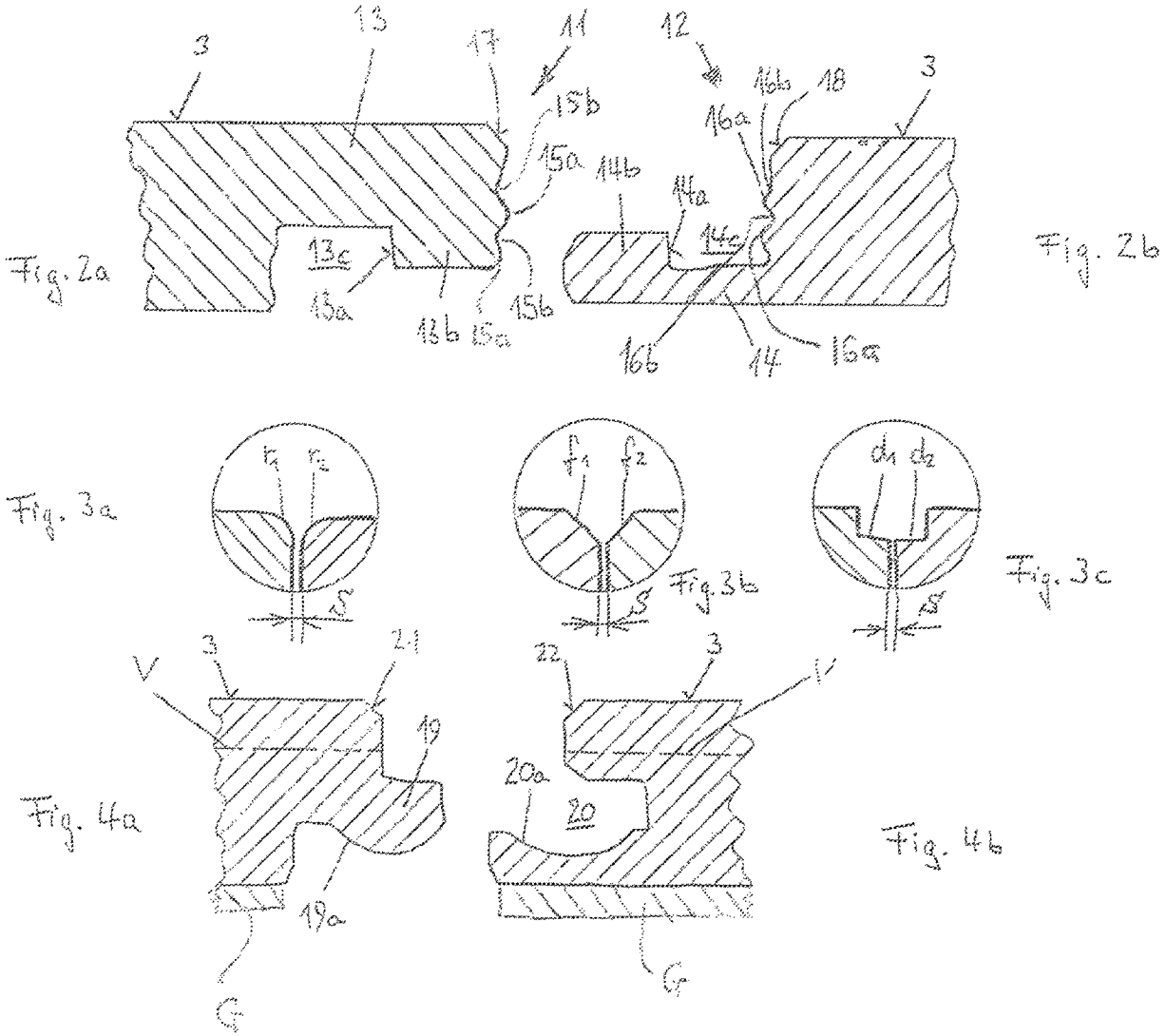
FIGS. 2*a*, 2*b* parts of complementary hook elements as the same can be provided on mutually opposite panel edges of a floor panel.
FIG. 3*a* an enlarged part of panel edges including an edge break-away point in the form of a radius.
FIG. 3*b* an enlarged part of panel edges including an edge break-away point in the form of a chamfer.
FIG. 3*c* an enlarged part of panel edges including an edge break-away point in the form of a shadow gap.
FIGS. 4*a*, 4*b* parts of panel edges including an undercut tongue that is complementary to a panel edge including an undercut groove, as the same can be provided on mutually opposite panel edges of a floor panel.

The FIGS. 2*a* and 2*b* show panel edges 11 and 12 including mechanical locking means in the form of hook elements 13 and 14. The hook elements 13 and 14 each have an undercut surface 13*a* respectively 14*a* which in the assembled state of two floor panels prevents a moving-apart of the floor panels in their panel plane and also vertically to the locked panel edge 11 respectively 12. The undercut surfaces provided for this purpose are provided on a part 13*b* respectively 14*b* of the respective hook element which protrudes vertically to the panel plane. Adjacent to the vertically protruding part 13*b* respectively 14*b* a hook recess 13*c* respectively 14*c* is provided which is configured in such a way that the vertically protruding part 13*b* respectively 14*b* of the hook element of the adjacent floor panel fits in this hook recess 13*c* respectively 14*c*.

Moreover, the hook elements 13 and 14 are designed in such a manner that in the locked state of two floor panels, additional undercuts counteract a moving-apart of the floor panels in a direction vertical to the panel plane. For this purpose, a corrugated profile 15 respectively 16 is provided on each of the hook elements and includes locking projections 15*a*/16*a* and locking recesses 15*b*/16*b*. The corrugated profile 15 of the hook element 13 is formed complementary to the corrugated profile 16 of the other hook element 14 so that the locking projections 15*a* of the hook element 13 fit in the locking recesses 16*b* of the other hook element 14.

The complementary corrugated profiles 15 and 16 are configured in such a manner that an elastic deformation of the plastic material allows the hook elements 13 and 14 to become locked without damaging their corrugated profiles 15 respectively 16.

A decorative layer 3 is provided, at the rim of which the panel edge of the floor panel according to FIG. 2*a* includes an edge break-away point in the form of a chamfer 17. The same applies to the decorative layer 3 according to FIG. 2*b* in which a chamfer 18 is provided at the rim.

The FIGS. 3*a*, 3*b* and 3*c* show parts of mutually adjacent panel edges of two locked floor panels. According to FIG. 3*a*, the panel edges each include an edge break-away point in the form of a radius $r_1$ and $r_2$. Between the panel edges there is a gap S as it can occur as a result of a mechanical load of the locking means. Due to the edge break-away point, this undesired gap S is optically imperceptible. Moreover, damaging of the panel edges is counteracted by the radii $r_1$ and $r_2$. In the ideal position, the panel edges are not moved apart and gap S does not exist, so that the panel edges abut each other (not shown).

The discussion of FIG. 3*a* analogously applies also to FIG. 3*b*, wherein only the edge break-away points are provided in the form of chamfers $f_1$ and $f_2$ instead of radii. The chamfers $f_1$ and $f_2$ correspond to the chamfers 17 and 18 according to the FIGS. 2*a* and 2*b*.

FIG. 3*c* shows a further alternative in which the edge break-away points are configured as a so-called shadow gap $d_1$ respectively $d_2$. This shadow gap is the removal of material in the form of a recess. In the present case, the recess has a rectangular cross section with a surface arranged parallel and also vertically to the panel plane. Incidentally, the discussion of FIG. 3*a* analogously applies also the embodiment according to FIG. 3*c*.

The FIGS. 4*a* and 4*b* show panel edges including a different type of complementary locking means, namely tongue and groove, as already provided in the example according to FIG. 1. The panel edge according to FIG. 4*a* includes a tongue having undercut 19*a*, while the panel edge according to FIG. 4*b* includes a groove 20 which is complementary to the above-described tongue 19 and includes an undercut 20*a*. For locking the groove and the tongue, the floor panel including the tongue is angled in an inclined fashion and is inserted in the groove. Thereafter, the angled floor panel is pivoted downward to the plane of the other floor panel thus producing a form-fit mechanical locking.

According to the FIGS. 4*a* and 4*b* a decorative layer 3 is provided on the upper side of the floor panels. At the rim of the decorative layer 3 the panel edge is respectively provided with an edge break-away point in the form of a chamfer 21 respectively 22. Of course, instead of a chamfer any other edge break-away point can be provided, such as an edge break-away point according to one of the FIG. 3*a*, 3*b* or 3*c*. As indicated by the dashed line, the carrier layer can be split and a reinforcement layer V can be provided that improves the dimensional stability of the floor panel.

Figure 5:
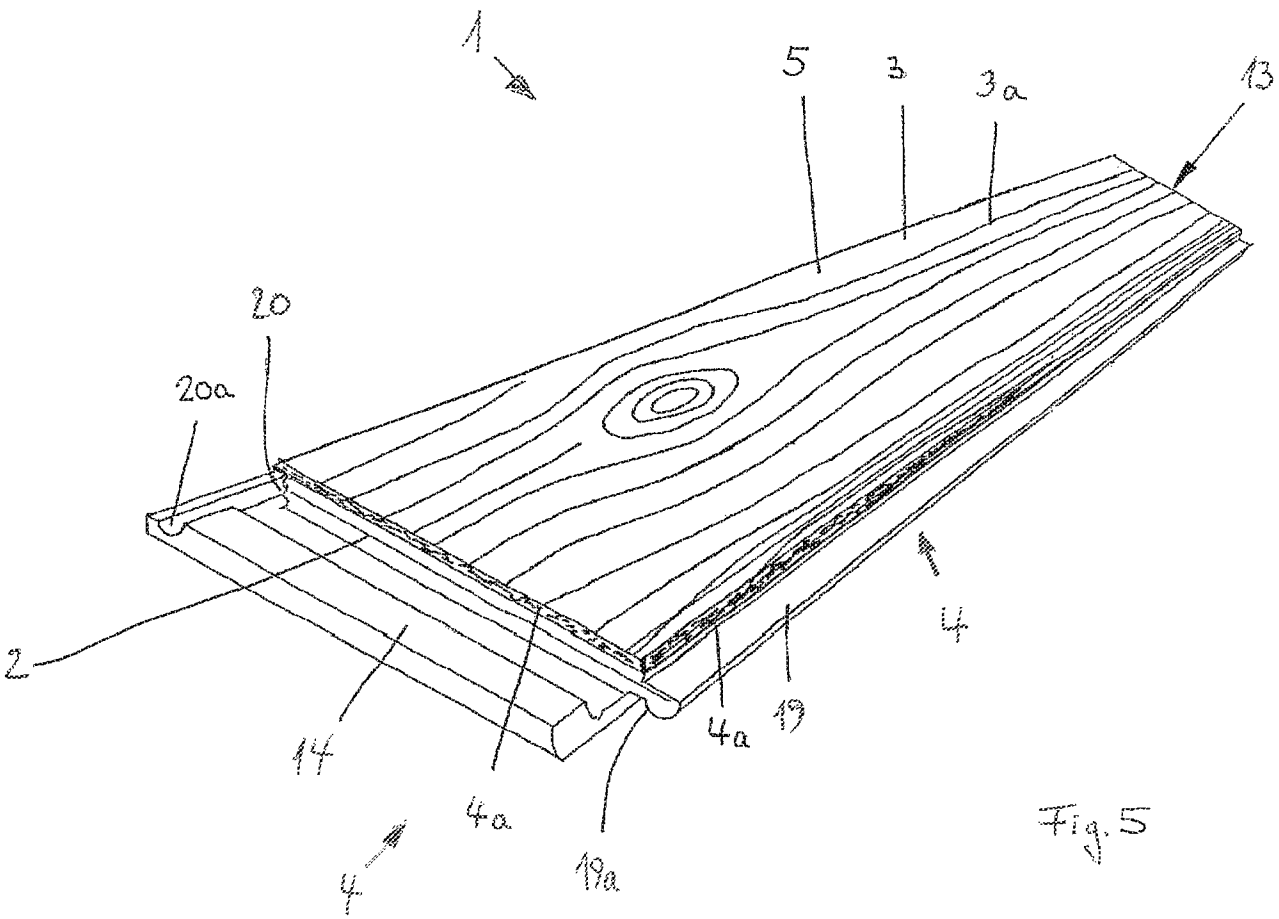
FIG. 5 a perspective view of a floor panel including tongue and groove on a first pair of mutually opposite panel edges and including complementary hook elements on a second pair of mutually opposite panel edges.

FIG. 5 shows a perspective view of an alternative floor panel 1 including complementary locking means in the form of a tongue 19 having an undercut 19*a* on a first pair of mutually opposite panel edges 1*c* and 1*d*. The tongue 19 is provided on the panel edge 1*d*. A complementary groove 20 including an undercut 20*a* is provided on the opposite panel edge 1*c*. The second pair of panel edges 1*a* and 1*b* includes complementary hook elements 13 respectively 14, as described by way of the FIGS. 2*a* and 2*b*. The alternative floor panel 1 comprises a carrier layer 2 made of a pliable and flexible plastic material. Above the carrier layer 2 a decorative layer 3 is disposed. The decorative layer 3 has shows a reproduction of a wood grain 3*a*. At the rim of the decorative layer 3 the panel edges 1*a*, 1*b* and 1*c*, 1*d* are provided with an edge break-away point in the form of a chamfer 4*a*. On the decorative layer 3 a transparent wear protection layer 5 is provided.

While specific embodiments of the invention have been shown and described in detail to illustrate the inventive principles, it will be understood that the invention may be embodied otherwise without departing from such principles.

I claim:

1. A floor panel comprising:

a carrier layer comprising a plastic material that is pliable and elastic at an application temperature of the floor panel;

a decorative layer being disposed above the carrier layer;

a first complementary mechanical locking means provided on a first two panel edges of the floor panel such that the floor panel is capable of being coupled together with a second floor panel of the same configuration as the floor panel to form a first locked state to counteract a moving apart of the floor panel and the second floor panel in a horizontal plane and a vertical plane;

a second complementary mechanical locking means provided on a second two panel edges such that the floor panel is capable of being coupled together with a third floor panel of the same configuration as the floor panel to form a second locked state to counteract a moving apart of the floor panel and the third floor panel in the horizontal plane and the vertical plane, wherein at least one edge of the first two panel edges or the second two panel edges has an edge break-away point at an edge of the decorative layer;

the second complementary locking means being complementary hook elements, the complementary hook elements forming the second locked state through a vertical movement between one of the complementary hook elements on one of the second two panel edges of the floor panel and another of the complementary hook elements on an opposite panel edge of the second two panel edges of the third floor panel;

each of the hook elements includes an inward facing vertical undercut surface, the inward facing vertical undercut surface of the one of the complementary hook elements of the floor panel and the inward facing vertical undercut surface of the other complementary hook element of the third floor panel cooperate in the second locked state to counteract a moving apart of the floor panel and the third floor panel in the horizontal plane; and each of the complementary hook elements has an outward facing vertical surface, each of the complementary hook elements has a locking projection on the outward facing vertical surface and each of the complementary hook elements has a locking recess on the outward facing vertical surface, the locking projections on each of the hook elements being at a distance from the surface of the panel, the locking projections on the outward facing vertical surface of the complementary hook elements fit in the locking recesses on the outward facing vertical surface of the complementary hook elements in the second locked state to counteract a moving apart of the floor panel and the third floor panel in the vertical plane, wherein the carrier layer is a split carrier layer, and further comprising a reinforcement layer arranged as at least one intermediate layer in the split carrier layer.

2. The floor panel according to claim 1, wherein the edge break-away point is designed as a chamfer, radius or stepped mortise.

3. The floor panel according to claim 1, wherein above the decorative layer a transparent wear protection layer is disposed.

4. The floor panel according to claim 1, wherein below the carrier layer a counteracting layer is provided.

5. The floor panel according to claim 1, wherein the plastic material of the carrier layer is a thermoplastic elastomer.

6. The floor panel according to claim 1, wherein the plastic material of the carrier layer is an amorphous elastomer, wherein plasticizers are added to the amorphous elastomer.

7. The floor panel according to claim 1, wherein the thickness of the floor panel amounts to 1.5 mm to 6 mm.

8. The floor panel according to claim 1, wherein the floor panel includes four panel edges.

9. The floor panel according to claim 8, wherein at least one of two mutually opposite panel edges of the first complementary mechanical locking means is provided with a groove and the opposite panel edge of the first complementary mechanical locking means is provided with a tongue formed complementary to the groove.

10. The floor panel according to claim 9, wherein the tongue and the groove each include an undercut, that the undercut of the tongue and the undercut of the groove are designed in such a manner that in the locked state they counteract a moving apart of the floor panels in their plane and vertically to the locked panel edge.

11. The floor panel according to claim 1, further comprising the reinforcement layer that includes fiber-reinforced material.

12. The floor panel according to claim 1, wherein an upwardly facing surface of one of the locking projections is in close contact with a downwardly facing surface of one of the locking recesses in the second locked state.

* * * * *